US008783416B2

(12) United States Patent
Singleton et al.

(10) Patent No.: US 8,783,416 B2
(45) Date of Patent: Jul. 22, 2014

(54) WIPING BAR QUICK CLAMP

(75) Inventors: Steven D. Singleton, Sarver, PA (US); W. Thomas Urmson, Jr., Valencia, PA (US); Charles A. Petrie, Warren, OH (US); Christopher Alan Lucke, Natrona Heights, PA (US)

(73) Assignee: L.B. Foster Rail Technologies, Inc., Burnaby, British Columbia (CA)

( * ) Notice: Subject to any disclaimer, the term of this patent is extended or adjusted under 35 U.S.C. 154(b) by 45 days.

(21) Appl. No.: 13/063,553

(22) PCT Filed: Sep. 21, 2009

(86) PCT No.: PCT/US2009/057658

§ 371 (c)(1), (2), (4) Date: Mar. 31, 2011

(87) PCT Pub. No.: WO2010/033900

PCT Pub. Date: Mar. 25, 2010

(65) Prior Publication Data

US 2012/0126073 A1 May 24, 2012

Related U.S. Application Data

(60) Provisional application No. 61/098,281, filed on Sep. 19, 2008.

(51) Int. Cl.
*B61K 3/00* (2006.01)

(52) U.S. Cl.
CPC ..... *B61K 3/00* (2013.01)
USPC ..... 184/3.1; 248/231.85; 248/228.2; 248/228.3; 248/229.12

(58) Field of Classification Search
CPC ..... B60M 5/00; B61K 3/00
USPC ..... 248/228.2, 228.4, 228.3, 222.51, 248/229.12, 229.16, 229.21, 231.31; 238/14.14, 14.05; 246/77, 247; 184/3.1
See application file for complete search history.

(56) References Cited

U.S. PATENT DOCUMENTS 804,787 A 11/1905 Young
1,097,704 A 5/1914 Cassidy et al.
(Continued)

FOREIGN PATENT DOCUMENTS

CA 2 771 994 3/2010
CN 2037746 U 5/1989
(Continued)

OTHER PUBLICATIONS

Extended European Search Report from European Application No. 09815329.9 mailed Dec. 5, 2013.

(Continued)

*Primary Examiner* — Terrell McKinnon
*Assistant Examiner* — Daniel J Breslin
(74) *Attorney, Agent, or Firm* — Merchant & Gould P.C.

(57) ABSTRACT

A clamp device for mounting a rail device onto a railroad rail includes a clamp body having an upper section and a lower section. The clamp body defines a recess portion between the upper and lower sections and a bore extending through the lower section of the clamp body. A bolt having a first end and a second end extends through the bore of the clamp body. The clamp device also includes a quick release mechanism having a lever arm and a cam member pivotally connected to the second end of the bolt. The lever arm is connected to the cam member and has a clamped position and a released position whereby pivoting the lever arm from the released position to the clamped position draws the first end of the bolt and the clamp body together.

23 Claims, 11 Drawing Sheets

(56) References Cited

U.S. PATENT DOCUMENTS

| | | | | | |
|---|---|---|---|---|---|
| 1,205,711 | A | | 11/1916 | Clark | |
| 1,546,778 | A | | 7/1925 | De Niff | |
| 1,630,584 | A | | 5/1927 | Schneider | |
| 1,669,603 | A | | 5/1928 | Derrick | |
| 1,728,412 | A | | 9/1929 | Humphries et al. | |
| 1,745,213 | A | | 1/1930 | Gray | |
| 1,803,923 | A | | 5/1931 | Tanner | |
| 1,878,259 | A | | 9/1932 | Bodkin | |
| 1,940,527 | A | | 12/1933 | Bolt | |
| 1,978,906 | A | | 10/1934 | Madison | |
| 1,979,447 | A | | 11/1934 | Butcher et al. | |
| 2,018,402 | A | | 10/1935 | Humphries et al. | |
| 2,185,810 | A | | 1/1940 | Heidenthal | |
| 2,262,852 | A | | 11/1941 | Martin | |
| 2,272,774 | A | | 2/1942 | McGarry | |
| 2,664,113 | A | * | 12/1953 | Dodge | 139/100 |
| 2,821,263 | A | | 1/1958 | Kerler | |
| 3,941,338 | A | * | 3/1976 | Knudsen | 246/77 |
| 4,220,322 | A | * | 9/1980 | Hobday | 269/6 |
| 4,436,294 | A | * | 3/1984 | Irelan | 269/6 |
| 4,753,424 | A | | 6/1988 | Sato et al. | |
| 5,156,508 | A | * | 10/1992 | Grisley | 411/354 |
| 5,217,213 | A | * | 6/1993 | Lii | 269/6 |
| 5,348,120 | A | | 9/1994 | Junk et al. | |
| 5,394,958 | A | | 3/1995 | Junk et al. | |
| 5,641,037 | A | * | 6/1997 | Wise et al. | 184/3.1 |
| 5,996,736 | A | * | 12/1999 | Stankiewicz | 182/127 |
| 6,009,978 | A | | 1/2000 | Chisholm | |
| 6,250,621 | B1 | * | 6/2001 | Ping | 269/181 |
| 6,742,624 | B2 | | 6/2004 | DiCarlo | |
| 6,971,479 | B1 | | 12/2005 | Urmson et al. | |
| 7,121,383 | B2 | | 10/2006 | Kumar et al. | |
| 7,258,201 | B2 | | 8/2007 | Urmson et al. | |
| 7,273,131 | B2 | | 9/2007 | Urmson et al. | |
| 8,025,279 | B2 | * | 9/2011 | Seber | 269/143 |
| 8,235,307 | B2 | * | 8/2012 | Schatz et al. | 238/14.14 |
| 2002/0056592 | A1 | | 5/2002 | Arens et al. | |
| 2005/0072252 | A1 | * | 4/2005 | Kumar et al. | 73/866.5 |
| 2006/0289666 | A1 | | 12/2006 | Sherriff et al. | |
| 2008/0047780 | A1 | | 2/2008 | Urmson et al. | |
| 2008/0083584 | A1 | | 4/2008 | Urmson et al. | |
| 2008/0223661 | A1 | | 9/2008 | Singleton et al. | |
| 2009/0000869 | A1 | | 1/2009 | Holland | |
| 2009/0000870 | A1 | | 1/2009 | Holland | |
| 2010/0300810 | A1 | | 12/2010 | Singleton et al. | |

FOREIGN PATENT DOCUMENTS

| | | | | | |
|---|---|---|---|---|---|
| CN | 2040059 | U | | 6/1989 | |
| EP | 1125787 | A2 | | 8/2001 | |
| EP | 1807489 | A1 | * | 7/2007 | C10M 173/02 |
| GB | 2 446 949 | | | 8/2008 | |
| JP | 51-160305 | | | 12/1976 | |
| JP | 2002-37068 | | | 2/2002 | |
| JP | 2002-145062 | | | 5/2002 | |
| JP | 2003-276604 | | | 10/2003 | |
| WO | 8700566 | A1 | | 1/1987 | |
| WO | WO 03/064233 | | | 8/2003 | |
| WO | WO 2006015494 | A1 | * | 2/2006 | B61K 3/00 |
| WO | WO 2010/033900 | | | 3/2010 | |
| WO | WO 2010/033907 | | | 3/2010 | |
| WO | WO 2010033907 | A3 | * | 7/2010 | |
| WO | WO 2010/138819 | | | 12/2010 | |

OTHER PUBLICATIONS

International Search Report and Written Opinion from International Application No. PCT/CA2013/050654 mailed Oct. 18, 2013.

International Preliminary Report on Patentability from International Application No. PCT/US2009/057671 mailed Mar. 22, 2011.

International Search Report and Written Opinion from International Application No. PCT/US2009/057671 mailed May 4, 2010.

International Search Report and Written Opinion from International Application No. PCT/US2010/036582 mailed Dec. 28, 2010.

Final Office Action from U.S. Appl. No. 12/788,971 mailed Mar. 14, 2013.

Office Action from U.S. Appl. No. 12/788,971 mailed Nov. 27, 2012.

Restriction Requirement Office Action from U.S. Appl. No. 12/788,971 mailed Oct. 12, 2012.

Australian Examination Report from Australian Application No. 2009293041 dated Jun. 20, 2013.

Chinese Office Action from Chinese Application No. 200980137073.2 mailed Apr. 23, 2013.

* cited by examiner

WIPING BAR QUICK CLAMP

CROSS-REFERENCE TO RELATED APPLICATION

This application claims the benefit of U.S. Provisional Application No. 61/098,281, filed Sep. 19, 2008, the entire content of which is hereby incorporated by reference.

BACKGROUND OF THE INVENTION

1. Field of the Invention

This invention relates to a clamp device and, more particularly, to a clamping device for maintaining a rail device in position with respect to a railroad rail.

2. Description of the Prior Art

In the operation of railroads, it has long been the practice to apply lubricant or friction modifying materials onto railroad rails, such as to the top of the rails or sides of the rails at curves, turnouts, switches, and in some cases, the sections of the track immediately before a switch, and periodically spaced along the length of the track. Reference may be made to U.S. Pat. Nos. 5,348,120 and 5,394,958 and U.S. Pat. Application Pub. No. 2008/0223661, which are hereby incorporated by reference, for a dissertation on rail lubrication and disclosure of rail lubrication systems and applicator bars (oftentimes referred to as "wiping bars") used therein.

Common to these prior art wiping bars is the need for rigidly securing the device to the railroad rails so that lubricant can be dispensed repeatedly at the desired rate and at the needed location. In most cases, this is accomplished through a mechanical connection to the rail itself, such as by bolting or clamping in various ways. However, the problems associated with such clamping means, among other things, is that the prior art wiping bars are often difficult to install and/or reinstall in the field whenever maintenance is performed on the rail or on the wiping bar itself.

FIG. 1 shows a typical wiping bar assembly W1 mounted on a railroad rail 10. The rail 10 includes a base 12 that has flanges 14 and 16 extending therefrom. The rail 10 also includes a head 18, and a web 20 connecting the base 12 and the head 18. Referring to FIG. 1, the wiping bar assembly W1 is secured to the railroad rail 10 using a prior art mounting support or clamp 24. Typically, it takes two spaced apart mounting clamps 24 for securing a typical wiping bar assembly W1 to a railroad rail. The wiping bar assembly typically includes a front blade extending lengthwise on the outside face of a lubricant manifold body and an elongated distribution blade extending lengthwise on the front blade. A flow passageway is defined in a portion of the manifold body and the distribution blade for material to pass through. The flow passageway defines an exit end for depositing material onto the head 18 of the rail 10. As shown in FIG. 1, the wiping bar assembly W1 is positioned to deliver material to the gage face of the head 18.

The mounting clamp 24 includes a body 26 having a first end 28 and a second end 30 and defining an upper section 32 and a lower section 34. A recess portion 36 is defined at the first end 28 between the upper section 32 and the lower section 34 of the body 26 of the clamp 24. The recess portion 36 receives a portion of the flange 16 of the base 12 of the rail 10 as shown. The size and shape of the recess portion 36 is such as to provide a tight fit when the flange 16 is received therein. A bore 38 is defined in the lower section 34 of the clamp body 26 slightly below the recess portion 36 and extends from the first end 28 to the second end 30 of the clamp 24. The mounting clamp 24 also includes a J-bolt 40 having a hook section 42 defining a recess 44 and a straight section 46 having an end portion 48. The recess 44 of the hook section 42 receives a portion of the flange 14 of the base 12 of the rail 10 as shown. The straight section 46 of the J-bolt 40, which extends below the base 12 of the rail 10, is received within the bore 38 such that the end portion 48 extends beyond the second end 30 of the clamp body 26. The end portion 48 may be threaded for receiving a threaded fastener 50, such as a nut. A downwardly extending hole 52, which may be internally threaded, is defined in an upper surface 54 of the clamp body 26, wherein the hole 52 is adapted to receive a fastener arrangement 56 for securing the wiping bar assembly W1 to the railroad rail 10.

With continued reference to FIG. 1, the attachment of the prior art mounting clamp 24 to the railroad rail 10 is set forth as follows. First, the straight section 46 of the J-bolt 40 is received within the bore 38 of the clamp body 26 and then placed underneath the base 12 such that the base flange 14 is received within the recess 44 of the hook section 42. The first end 28 of the clamp body 26 is placed adjacent the base 12 of the rail 10 such that the flange 16 is received within the recess portion 36 of the body 26 of the clamp 24. A nut 50 or other fastener arrangement such as a nut and lockwasher is placed on the threaded end portion 48 and rotated toward the second end 30, thus drawing the hook section 42 of the J-bolt 40 and the mounting clamp 24 together for tight securement (including lateral securement) to the railroad rail 10. The wiping bar assembly W1 may then be fastened to the upper surface 54 of the clamp body 26 as indicated at 56. When removing and/or installing the prior art mounting clamp 24, such as during maintenance of the wiping bar assembly W1 and/or the railroad rail 10, a tool such as a socket wrench may be used to tighten or unloosen the nut 50 on the J-bolt 40. In most prior art clamps of this type, the tightening and/or unloosening process is relatively slow and tedious, thus making installation and removal of the wiping bar assembly W1 difficult and time consuming. This is particularly a concern for a rail lubrication system that contains at least four wiping bars totaling eight mounting clamps 24.

SUMMARY OF THE INVENTION

In one embodiment, a clamp device for mounting a rail device onto a railroad rail includes a clamp body having an upper section and a lower section. The clamp body defines a recess portion between the upper and lower sections and a bore extending through the lower section of the clamp body. The recess portion is configured to receive a portion of a rail flange. The clamp device also includes a bolt having a first end and a second end. The bolt extends through the bore of the clamp body with the first end of the bolt being configured to receive a portion of a rail flange. The clamp device further includes a quick release mechanism having a lever arm and a cam member. The cam member is pivotally connected to the second end of the bolt. The lever arm is connected to the cam member and has a clamped position and a released position whereby pivoting the lever arm from the released position to the clamped position causes the cam member to engage a second end of the clamp body and displace the bolt within the bore of the clamp body such that the first end of the bolt and the clamp body are drawn together.

The clamp device may further include a spring positioned adjacent one of the first end and the second end of the bolt. A locking bracket may be positioned between the second end of the clamp body and the cam member with the locking bracket having a body with a first section and a second section. The first section of the locking bracket is pivotally connected to the second section and defines an opening for receiving the bolt. The second section has a lip that engages a ledge defined by the cam member when the lever arm is in the clamped position. The first end of the bolt may include a hook section defining a recess for receiving a portion of a rail flange. In a particular embodiment, the first end of the bolt includes a base receiving member having a body defining a recess for receiving a portion of a rail flange.

The bolt may include one or more sections. In certain embodiments, the bolt includes a hook section, a straight section having a threaded portion, and a shaft section. The hook section corresponds to the first end of the bolt with the hook section defining a recess for receiving a portion of a rail flange and the shaft section corresponds to the second end of the bolt. The shaft section receives the threaded portion of the straight section. In a further embodiment, the bolt includes a base receiving member, a straight section having a threaded portion, and a shaft section. The base receiving member corresponds to the first end of the bolt and includes a body defining a recess for receiving a portion of a rail flange. The shaft section corresponds to the second end of the bolt and the shaft section receives the threaded portion of the straight section.

The cam member may include an abutting surface, a curved portion, and a straight portion. The abutting surface engages the second end of the clamp body when the lever arm is in the released position, the curved portion engages the second end of the clamp body when the lever arm transitions between the released positioned and the clamped position, and the straight section engages the second end of the clamp body when the lever arm is in the clamped position.

In another embodiment, a clamp device for mounting a rail device onto a railroad rail includes a clamp body having an upper section and a lower section. The clamp body defines a recess portion between the upper and lower sections and a bore extending through the lower section of the clamp body. The recess portion is configured to receive a portion of a rail flange. A bolt having a first end, a second end, and a head portion extends through the bore of the clamp body. The head portion of the bolt is positioned adjacent the second end of the bolt and is configured to engage the clamp body. The clamp device also includes a base receiving member positioned adjacent the first end of the bolt. The base receiving member has a body defining a recess portion configured to receive a portion of a rail flange. The clamp device further includes a quick release mechanism having a lever arm and a cam member. The cam member is pivotally connected to the first end of the bolt. The lever arm is connected to the cam member and has a clamped position and a released position whereby pivoting the lever arm from the released position to the clamped position causes the cam member to engage the base receiving member and displace the bolt within the bore of the clamp body such that the base receiving member and the clamp body are drawn together.

A spring may be positioned adjacent one of the first end and the second end of the bolt. A locking bracket may be positioned between the base receiving member and the cam member. The locking bracket has a body with a first section and a second section. The first section is pivotally connected to the second section and defines an opening for receiving the bolt. The second section has a lip that engages a ledge defined by the cam member when the lever arm is in the clamped position. In certain embodiments, the bolt includes a straight section having a threaded portion, and a shaft section corresponding to the first end of the bolt where the shaft section receives the threaded portion of the straight section. In a further embodiment, the cam member includes an abutting surface, a curved portion, and a straight portion. The abutting surface engages the base receiving member when the lever arm is in the released position, the curved portion engages the base receiving member when the lever arm transitions between the released positioned and the clamped position, and the straight section engages the base receiving member when the lever arm is in the clamped position.

In yet another embodiment, a method of securing a clamp device for mounting a rail device onto a railroad rail includes the steps of: positioning a clamp body adjacent to a first flange of a railroad rail, where the clamp body defines a recess portion and a bore extending through the clamp body; positioning a first end of a bolt adjacent to a second flange of the railroad rail, where the bolt extends through the bore of the clamp body; and pivoting a quick release mechanism from a released position to a clamped position such that the first end of the bolt and the clamp body are drawn together and the recess portion of the clamp and the first end of the bolt engage respective portions of the first and second flanges. The method may further include the step of securing the quick release mechanism in the clamped position by engaging the quick release mechanism with a locking bracket when the quick release mechanism is in the clamped position. The first end of the bolt may include a hook section defining a recess for receiving a portion of the second flange. In certain embodiments, the first end of the bolt may include a base receiving member having a body defining a recess for receiving a portion of a rail flange. The method may also includes the step of adjusting a length of the bolt by displacing a threaded portion of the bolt within a shaft section of the bolt, where the shaft section has a threaded portion to receive the threaded portion of the bolt.

In yet a further embodiment, a method of securing a clamp device for mounting a rail device onto a railroad rail includes the steps of positioning a clamp body adjacent to a first flange of a railroad rail, where the clamp body defines a recess portion and a bore extending through the clamp body; positioning a first end of a bolt adjacent to a second flange of the railroad rail, where the bolt extends through the bore of the clamp body; and actuating a spring-loaded quick release mechanism from a released position to a clamped position such that the first end of the bolt and the clamp body are drawn together and the recess portion of the clamp and the first end of the bolt engage respective portions of the first and second flanges.

DESCRIPTION OF THE PREFERRED EMBODIMENTS

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

Figure 1:
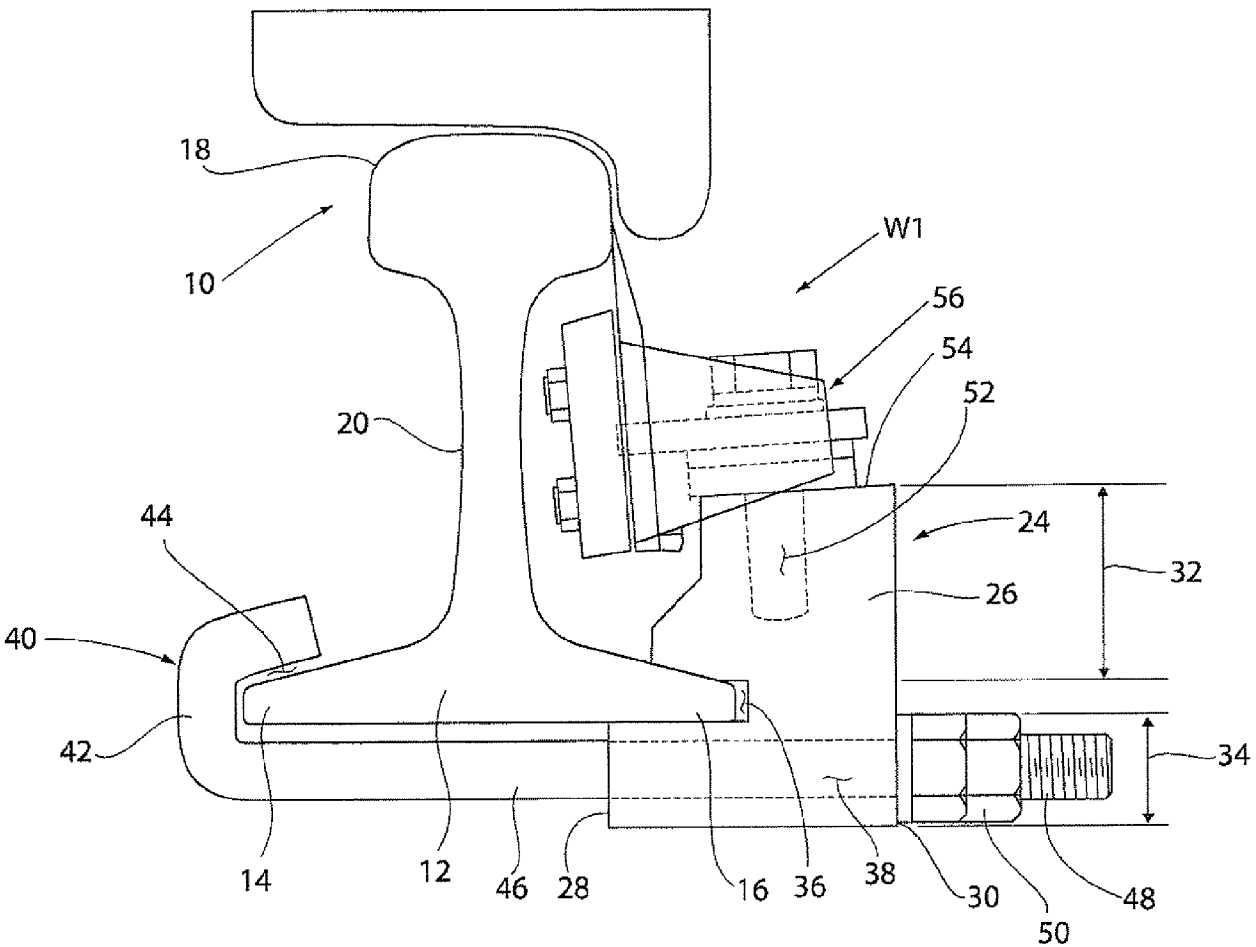
FIG. 1 PRIOR ART
FIG. 1 is an elevational side view of a typical wiping bar mounted to a railroad rail using a prior art mounting clamp.
Figure 2:
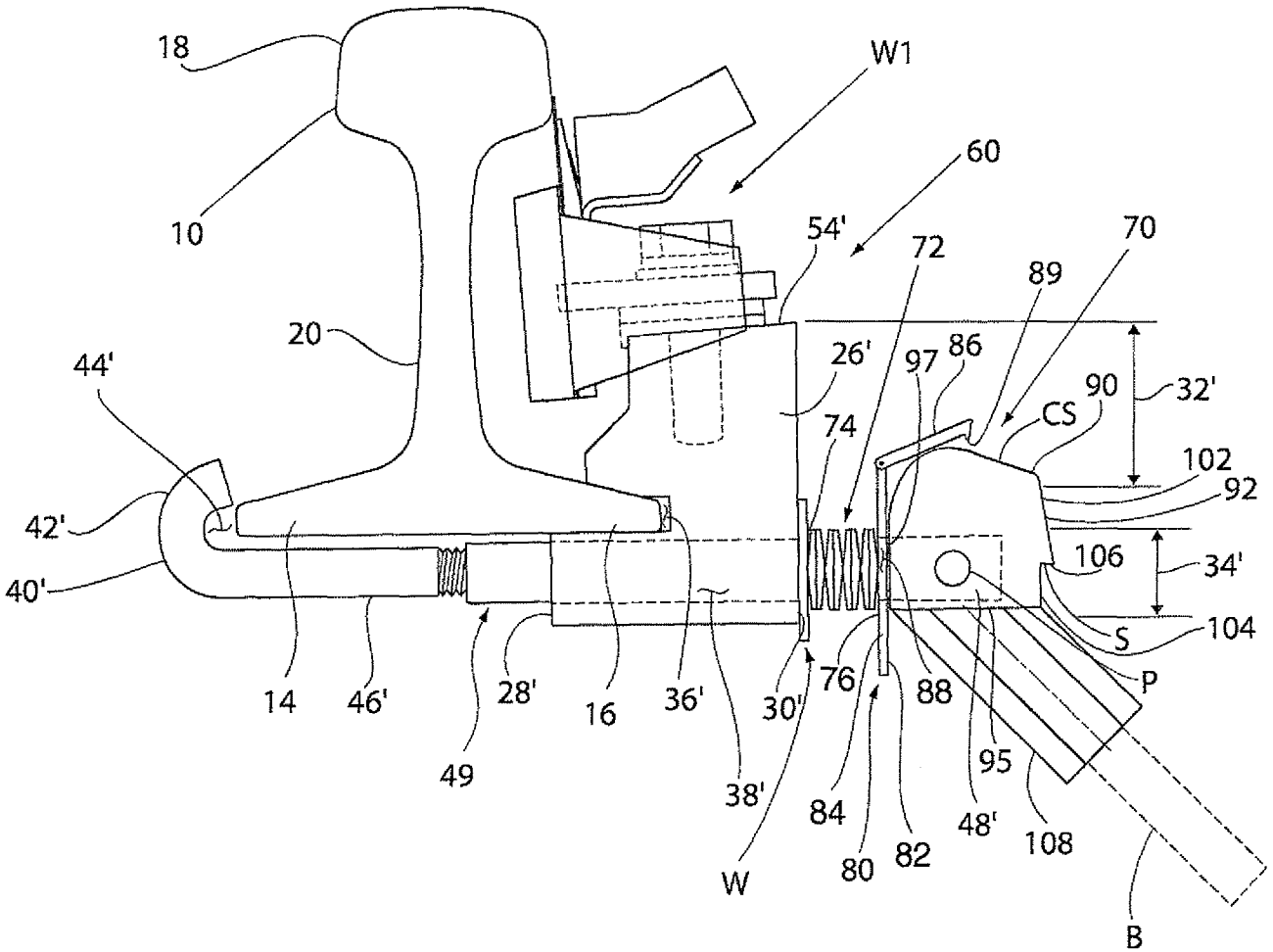
FIG. 2 is an elevational side view of a clamp device according to one embodiment, wherein the clamp device is shown mounted to a railroad rail in a released position.
Figure 3:
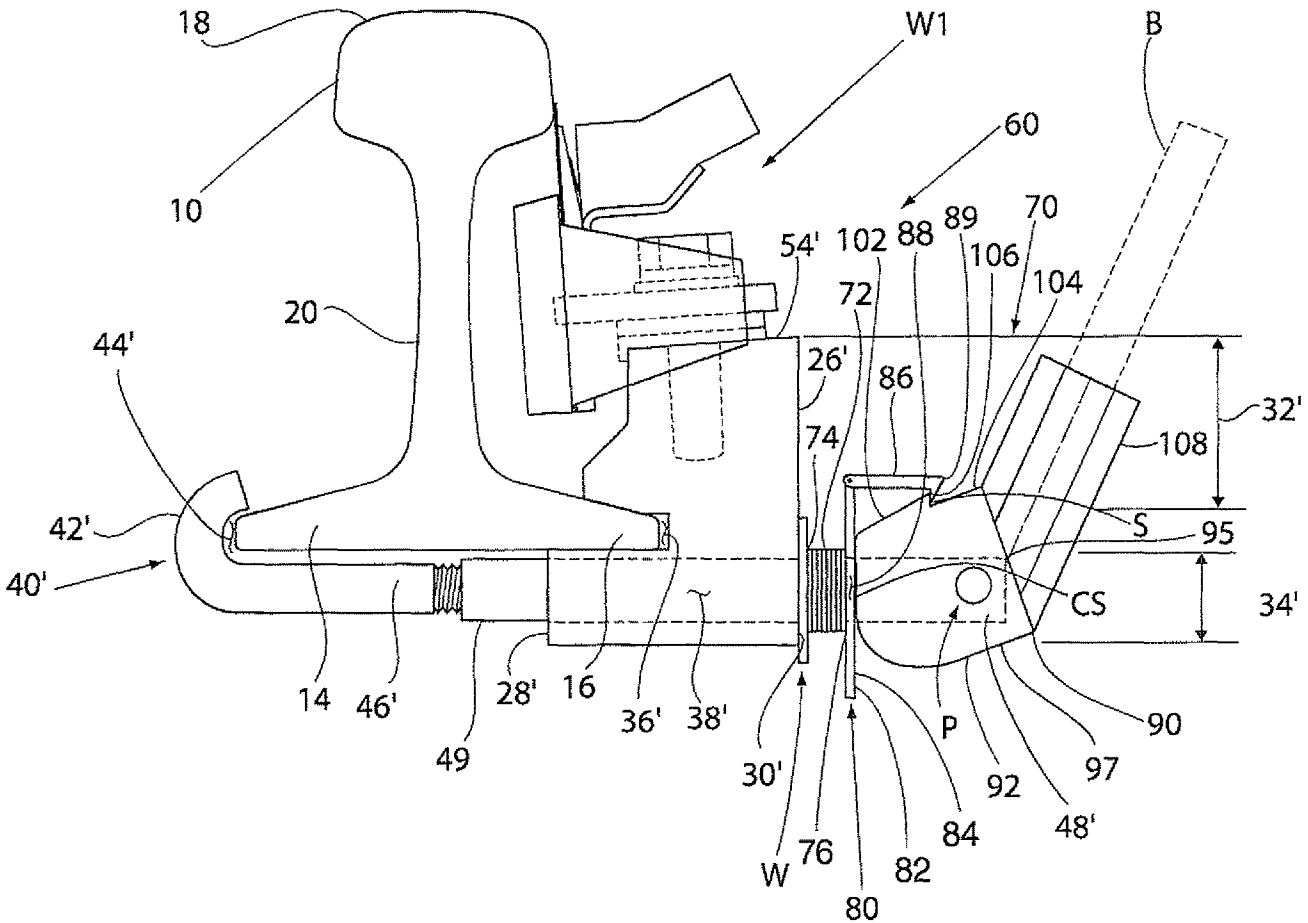
FIG. 3 is an elevational side view of the clamp device shown in FIG. 2, wherein the clamp device is shown mounted to a railroad rail in a clamped position.

Referring to FIGS. 2 and 3, one embodiment of the present invention provides for a mounting clamp 60 that quickly engages and releases for mounting a rail device, such as a wiping bar assembly W1 or a sensor (not shown), onto a railroad rail 10. The clamp 60 is somewhat similar to the prior art clamp 24 and, therefore, like reference numerals are used for like parts. The mounting clamp 60 includes a body 26' having a first end 28' and a second end 30' and defines an upper section 32' and a lower section 34'. A recess portion 36' is defined at the first end 28' between the upper section 32' and the lower section 34' of the body 26' of the clamp 60. The recess portion 36' is configured to receive a portion of the flange 16 of the base 12 of the rail 10 as shown. A bore 38' (shown in phantom) is defined in the lower section 34' of the clamp body 26' slightly below the recess portion 36' and extends from the first end 28' to the second end 30' of the clamp 60. The wiping bar assembly W1 is secured to an upper surface 54' of the clamp body 26'. Typically, two spaced apart mounting clamps 60 are utilized for securing the wiping bar assembly W1 to the railroad rail 10. For example, a first mounting clamp 60 may be secured to one end of the wiping bar assembly W1 and a second mounting clamp 60 may be secured to the other end of the wiping bar assembly W1. The mounting clamp 60 also includes a J-bolt 40' having a hook section 42' defining a recess 44' and a straight section 46'. The length of the J-bolt 40' may be adjustable to accommodate varying widths of the flanges 14, 16 of the base 12 of the rail 10. The J-bolt 40' includes an internally threaded shaft section 49 and the straight section 46' includes a threaded portion. The threaded portion of the straight section 46' is received by the corresponding internally threaded shaft section 49. The internally threaded shaft section 49 passes through the bore 38' and extends beyond the second end 30' of the clamp body 26' and defines an end portion 48'. Rather than providing a nut 50 received on the end portion 48 of J-bolt 40 as shown in FIG. 1 of the prior art, the end portion 48' of clamp 60 includes a quick release mechanism 70 attached thereto.

With continued reference to FIGS. 2 and 3, the quick release mechanism 70 includes a spring 72, a quick release cam member 90 and a locking bracket 80 positioned therebetween on the shaft section 49 of the J-bolt 40'. The spring 72 has a first end 74 and a second end 76 and is received on the shaft section 49 such that the first end 74 abuts against the second end 30' of the clamp body 26' and the second end 76 abuts against the locking bracket 80 received on the end portion 48' of the shaft section 49 of the J-bolt 40'. The spring 72 may be a compression coil spring, a single disc spring or a set of multiple disc springs. The spring 72 can also be made by combining a plurality of beveled washers. A washer W may be positioned between the first end 74 of the spring 72 and the second end 30' of the clamp body 26'. The locking bracket 80 includes a body 82 having a first section 84 and a second section 86. The first section 84 defines an opening 88 to receive the end portion 48' of the shaft section 49 of the J-bolt 40'. The second section 86 is pivotably attached to the first section 84 at an upper end thereof. The second section 86 pivotably extends in a direction away from the spring 72 and further includes a lip 89 at an end thereof. The lip 89 acts as a locking mechanism when the clamp 60 is secured to the railroad rail 10 as will be discussed in more detail below.

Figure 2A:
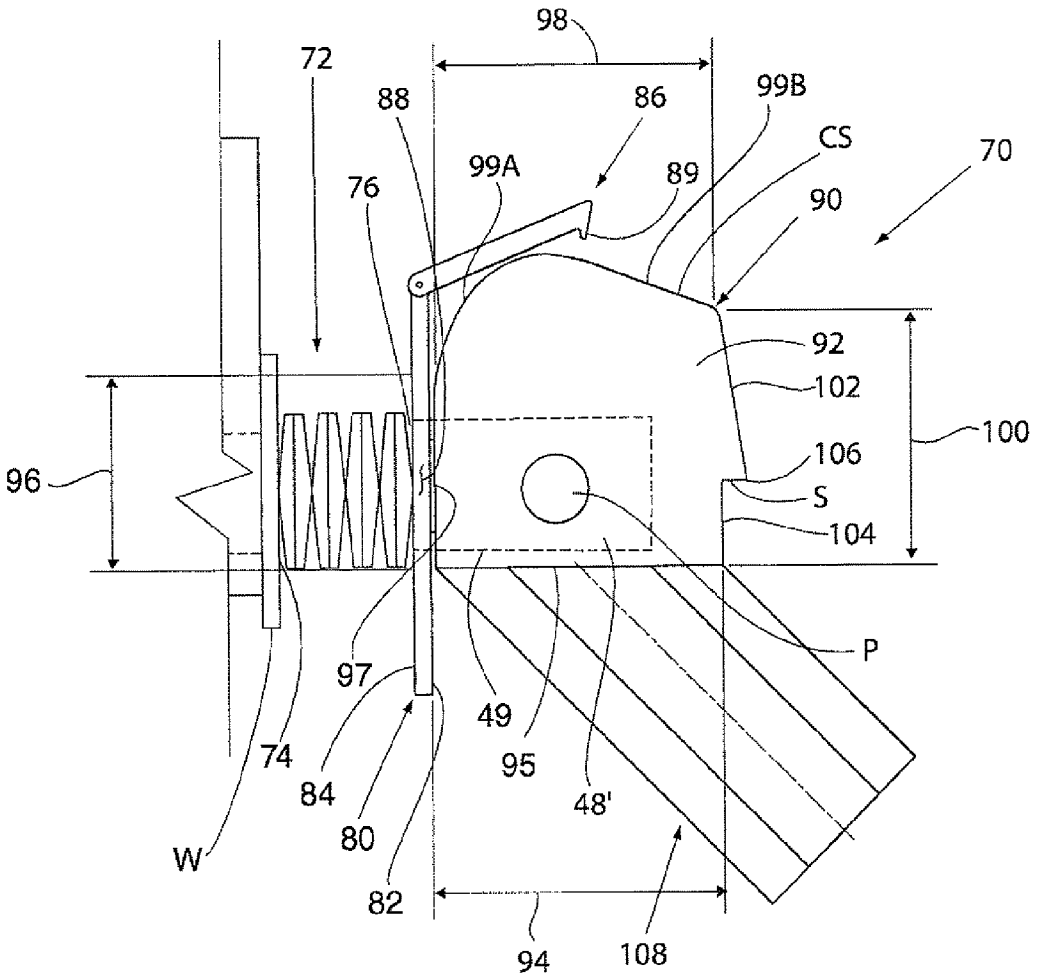
FIG. 2A is an enlarged elevational side view of the clamp device shown in FIG. 2.
Figure 3A:
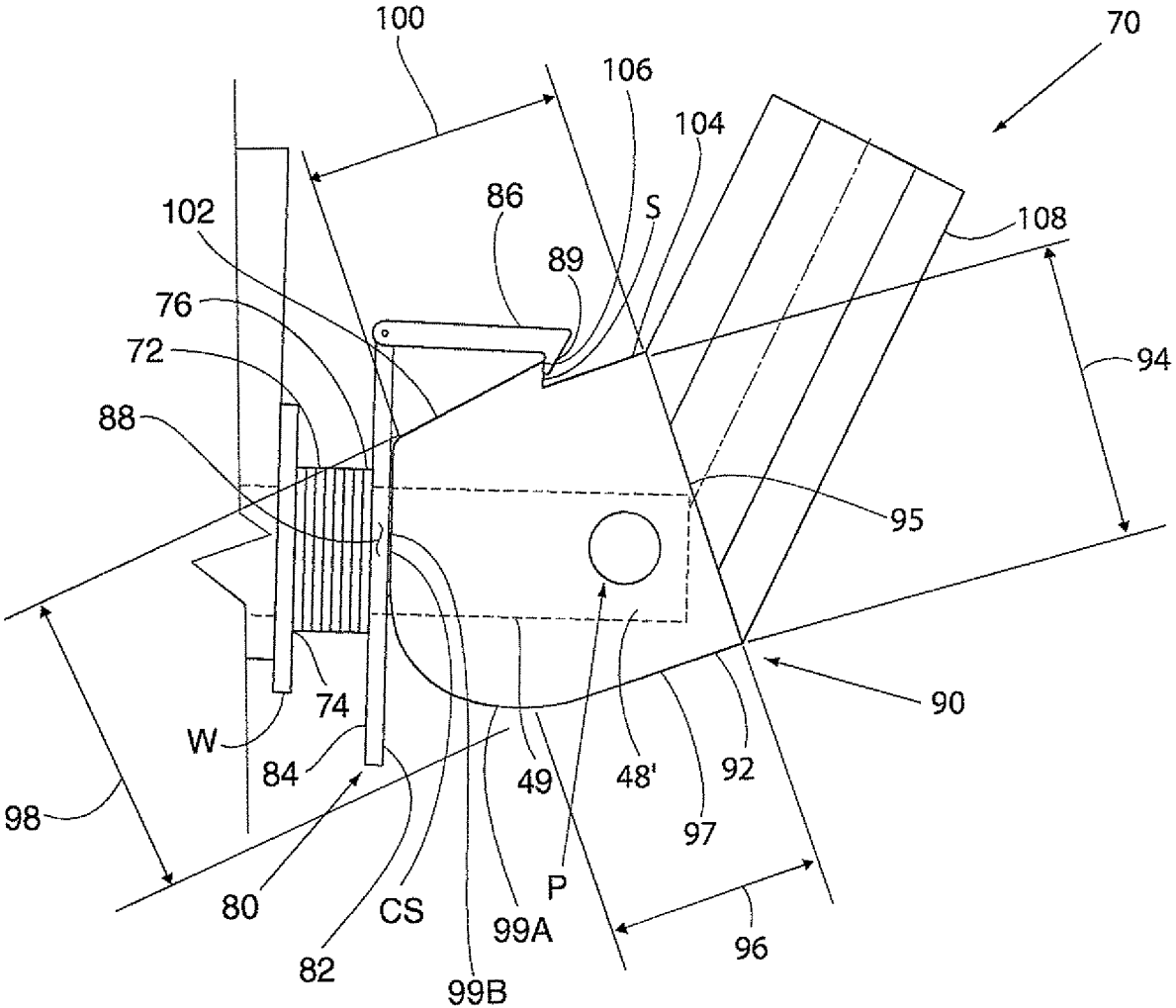
FIG. 3A is an enlarged elevational side view of the clamp device shown in FIG. 2 in a clamped position.

Referring to FIGS. 2A and 3A and with continued reference to FIGS. 2 and 3, the cam member 90 includes a body 92 defining a first section 94, a second section 96, a third section 98 and a fourth section 100. A pivot pin P extends through the body 92 and is received within a hole (not shown) defined on the end portion 48' of the shaft section 49 thereby pivotally connecting the cam member 90 to the shaft section 49 of the J-bolt 40'. Alternatively, there may be a plurality of spaced apart holes (not shown) in the end portion 48' of the shaft section 49 of the J-bolt 40' such as to longitudinally adjust the cam member 90 along a length of the end portion 48 to either increase or decrease the distance that the hook section 42' extends away from the first end 28' of the clamp body 26'. The first section 94 includes a flat surface 95. Further, a lever arm 108 defining a socket is connected to the cam member 90 and extends from the first section 94 at an angle away from the first section 94. The second section 96 includes an abutting surface 97 that is configured to abut against or engage the first section 84 of the bracket 80 when the clamp 60 is in a released position as shown in FIGS. 2 and 2A. The third section 98 includes a curved portion 99A and a straight portion 99B. The straight portion 99B defines a contacting surface CS that is configured to abut against or engage the first section 84 of the bracket 80 when the clamp 60 is in a clamped position as shown in FIGS. 3 and 3A. The fourth section 100 includes a first portion 102 and a second portion 104. A ledge 106 having a surface S separates the first portion 102 from the second portion 104. When the cam member 90 is rotated counterclockwise into the clamped position as shown in FIGS. 3 and 3A, the surface S of the ledge 106 contacts the lip 89 of the second section 86 of the body 82 of the bracket 80, thus preventing the body 92 of the cam member 90 from rotating clockwise back into the released position.

In operation as shown in FIGS. 2 and 3, the J-bolt 40' of the clamp 60 is placed underneath the base 12 such that recess 44' of the hook section 42' is positioned adjacent the base flange 14 of the rail 10. Further, the recess portion 36' of the clamp body 26' is positioned adjacent the other base flange 16 of the rail 10. Referring to FIG. 3, the lever arm 108 of the quick release mechanism 70 is actuated or pivoted from the released position counterclockwise along an axis of the pivot pin P such that the contacting surface CS of the third section 98 abuts against the first section 84 of the bracket 80 so that the ledge surface S contacts the lip 89 of the second section 86 of the bracket 80 thus locking the cam 90 into the clamped position. The abutting surface 97 of the cam member 90 abuts the second end 30' of the clamp body 26' via the locking bracket 80 and the spring 72 when the lever arm 108 is in the released position. The curved portion 99A of the cam member 90 abuts the second end 30' of the clamp body 26' via the locking bracket 80 and coacts with the spring 72 when the lever arm 108 transitions between the released position and the clamped position. The straight portion 99B of the cam member 90 abuts the second end 30' of the clamp body 26' via the locking bracket 80 and wads with the spring 72 when the lever arm 108 is in the clamped position.

Rotation of the quick release mechanism 70 may be accomplished by passing a bar B (shown in phantom) through the socket or opening defined in the lever arm 108. The rotation of the cam 90 about the axis of the pivot pin P forces the hook section 42' of the J-bolt 40' to engage a portion of the base flange 14 and compresses the spring 72 by the force of the cam 90 against the bracket 80. The compression force of the spring 72 applies pressure to the second end 30' of the clamp body 26' such that the recess portion 36' engages a portion of the base flange 16. Thus, as the lever arm 108 is transitioned from the released position to the clamped position, the J-bolt 40' is displaced within the bore 38' of the clamp body 26' thereby drawing the hook section 42' of the J-bolt 40' and the clamp body 26' together to secure the clamp 60 to the flanges 14, 16 of the base 12 of the railroad rail 10.

Removal of the clamp 60 is accomplished by unhooking the lip 89 by pivotably moving the second section 86 of the bracket 80 away from the ledge surface S and rotating the lever arm 108 clockwise via the bar B such that the abutting surface 97 of the second section 96 of the cam body 92 abuts against the first section 84 of the bracket 80. Rotation of the lever arm 108 decompresses the spring 72 and increases the distance the J-bolt 40' extends away from the second end 30' of the clamp body 26'. The clamp body 26' and the hook section 42' are then removed from engagement with the rail base flanges 14 and 16. Although the quick clamp mechanism 70 is shown and described utilizing the locking bracket 80, the over-center cam arrangement of the quick clamp mechanism 70 allows the clamping to be positive or self-locking. Thus, the locking bracket 80 is not required to ensure that the quick clamp mechanism 70 is maintained in the clamped position.

Figure 4:
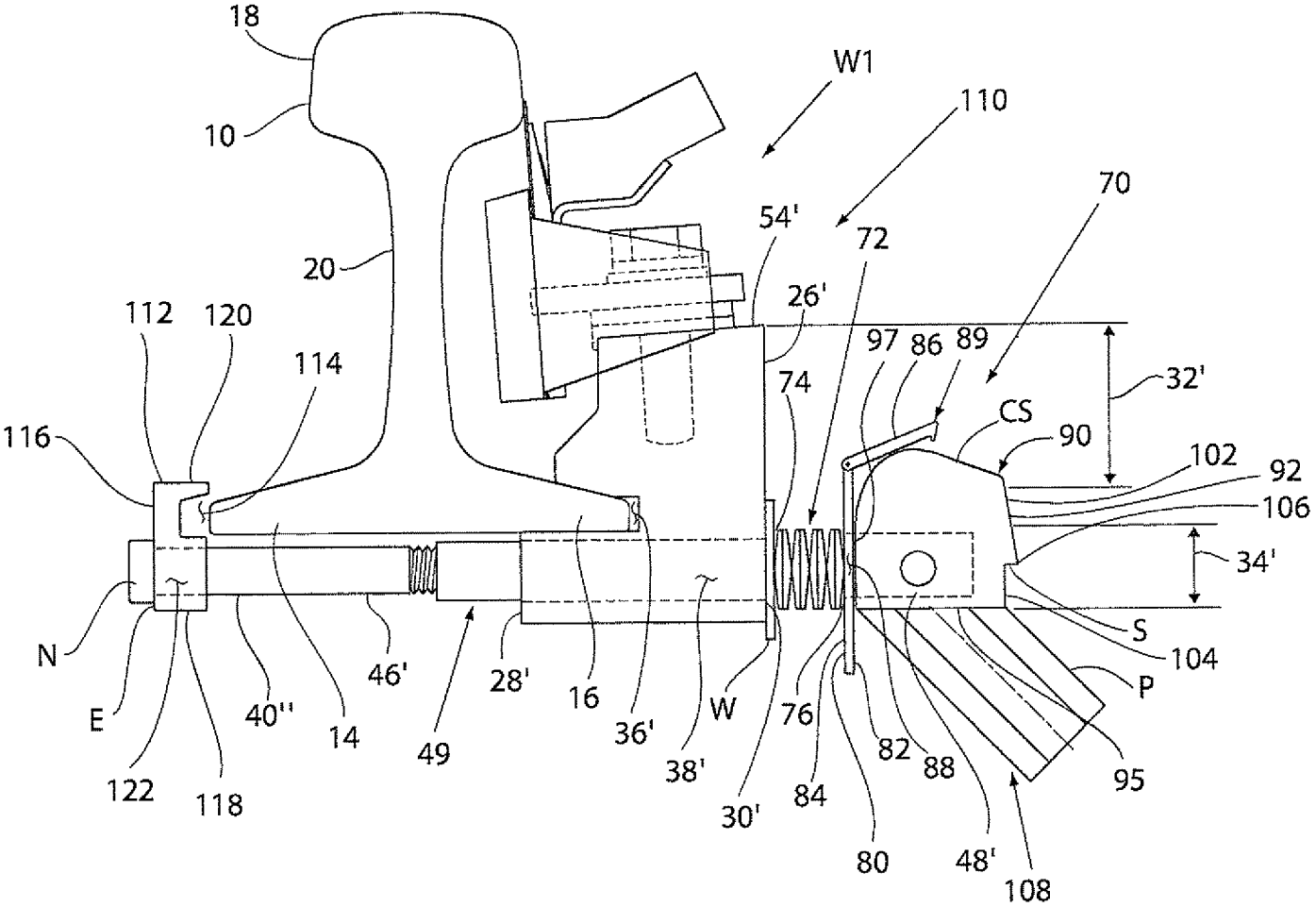
FIG. 4 is an elevational side view of a clamp device according to a further embodiment, wherein the clamp device is shown mounted to a railroad rail in a released position.
Figure 5:
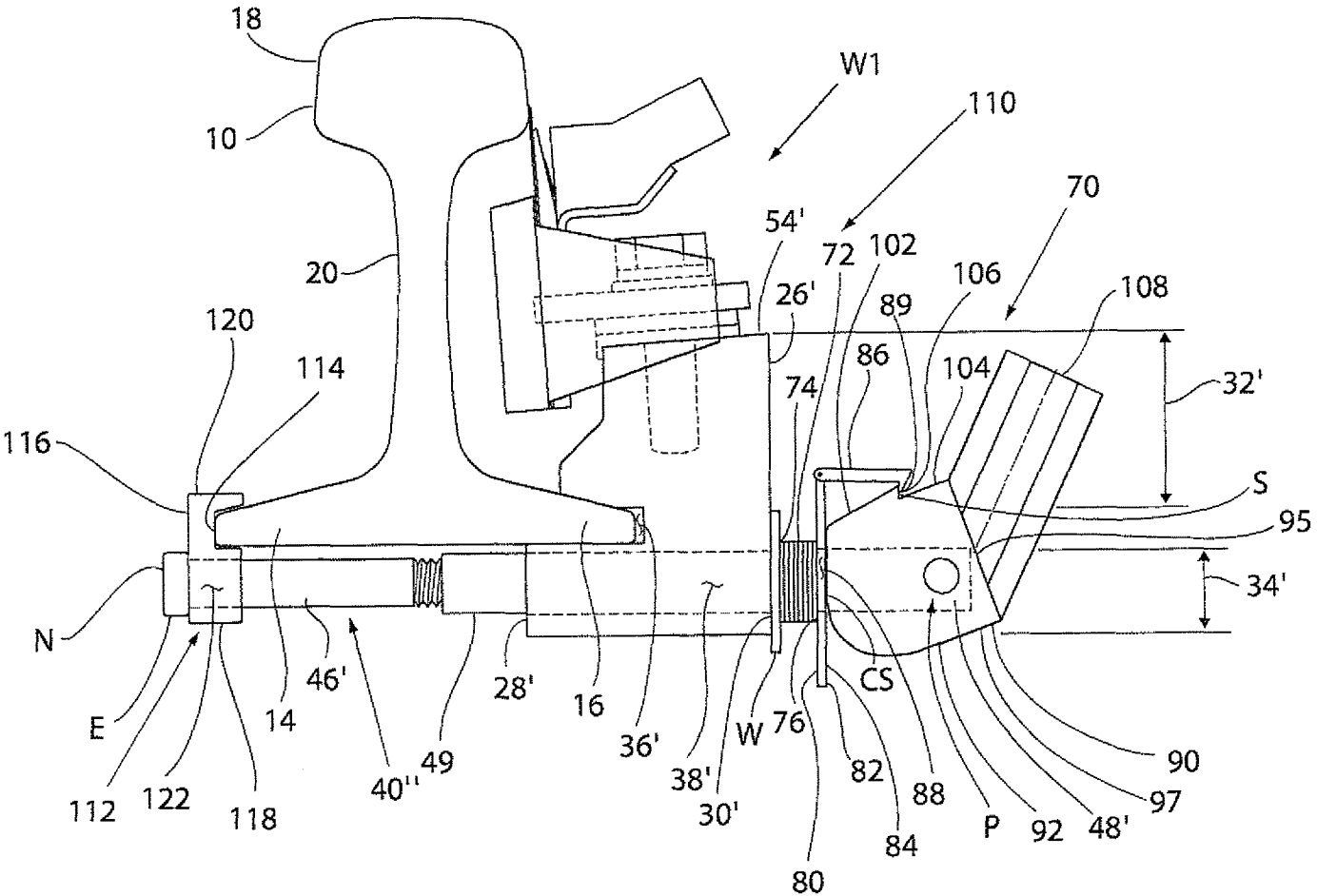
FIG. 5 is an elevational side view of the clamp device shown in FIG. 4, wherein the clamp device is shown mounted to a railroad rail in a clamped position.

FIGS. 4 and 5 show a second embodiment of a mounting clamp 110 that is similar to mounting clamp 60, except for the differences noted below. Like reference numerals are used for like parts. Instead of clamp 60 having a J-bolt 40' with a hooked section 42', clamp 110 includes a bolt 40" having only a straight section 46' that can be threaded at an end E thereof to receive a base receiving member 112 defining a recess portion 114 therein for receiving the base flange 14 of the railroad rail 10. The member 112 includes a body 116 having a first section 118 and a second section 120 with the recess portion 114 being defined therebetween. A bore 122 (shown in phantom) is defined in the first section 118 for receiving the straight section 46' of the bolt 40". The bore 122 may be internally threaded to longitudinally adjust along the straight section 46' of the bolt 40". The straight section 46' of the bolt 40" includes a head portion N, which may be a nut positioned at the end E, to secure the member 112 thereto. The head portion N may also be a fixed portion of the straight section 46' of the bolt 40" that extends radially outward from the bolt 40". The clamp 110 also operates in the same manner as clamp 60.

Figure 6:
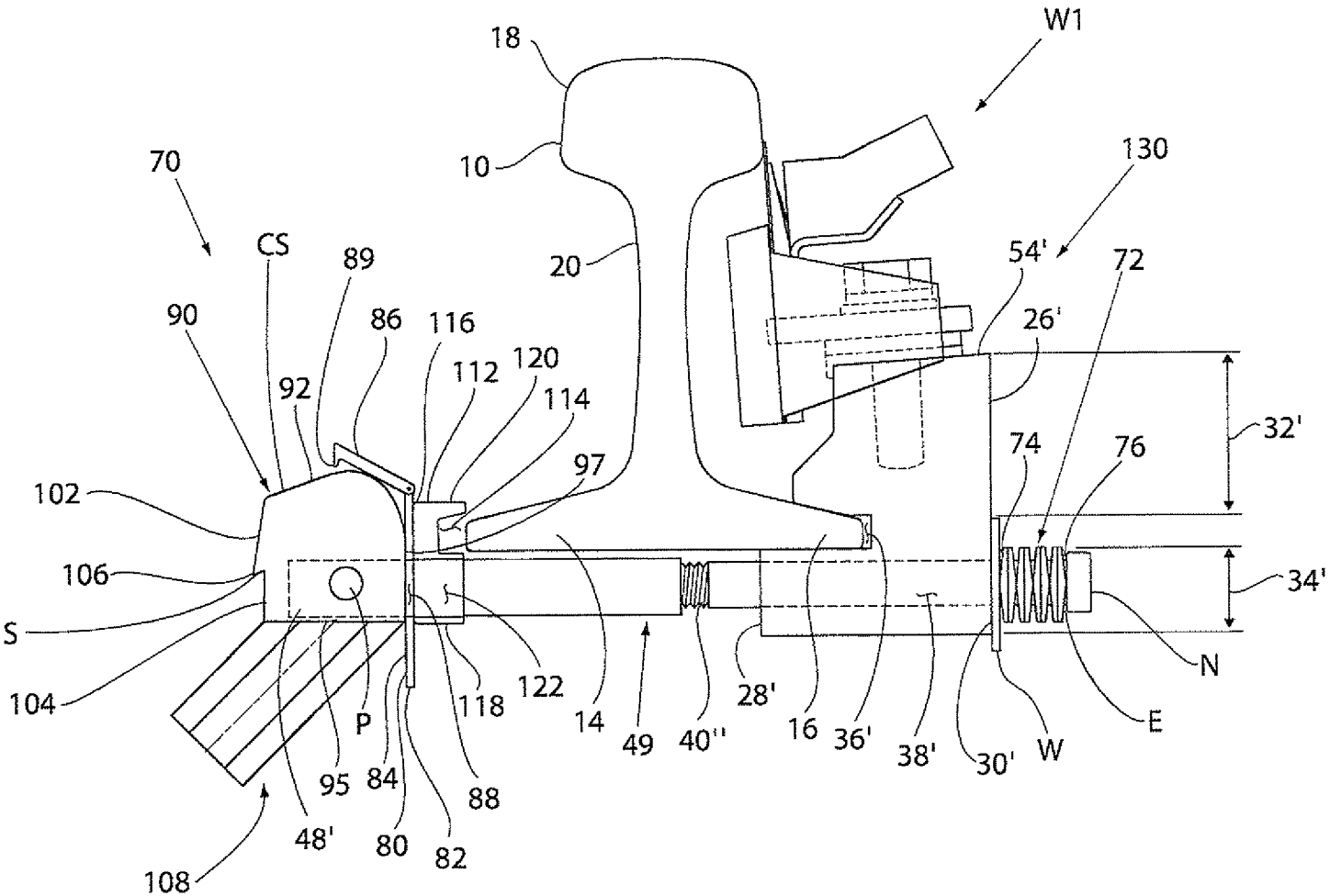
FIG. 6 is an elevational side view of a clamp device according to another embodiment, wherein the clamp device is shown mounted to a railroad rail in a released position.
Figure 7:
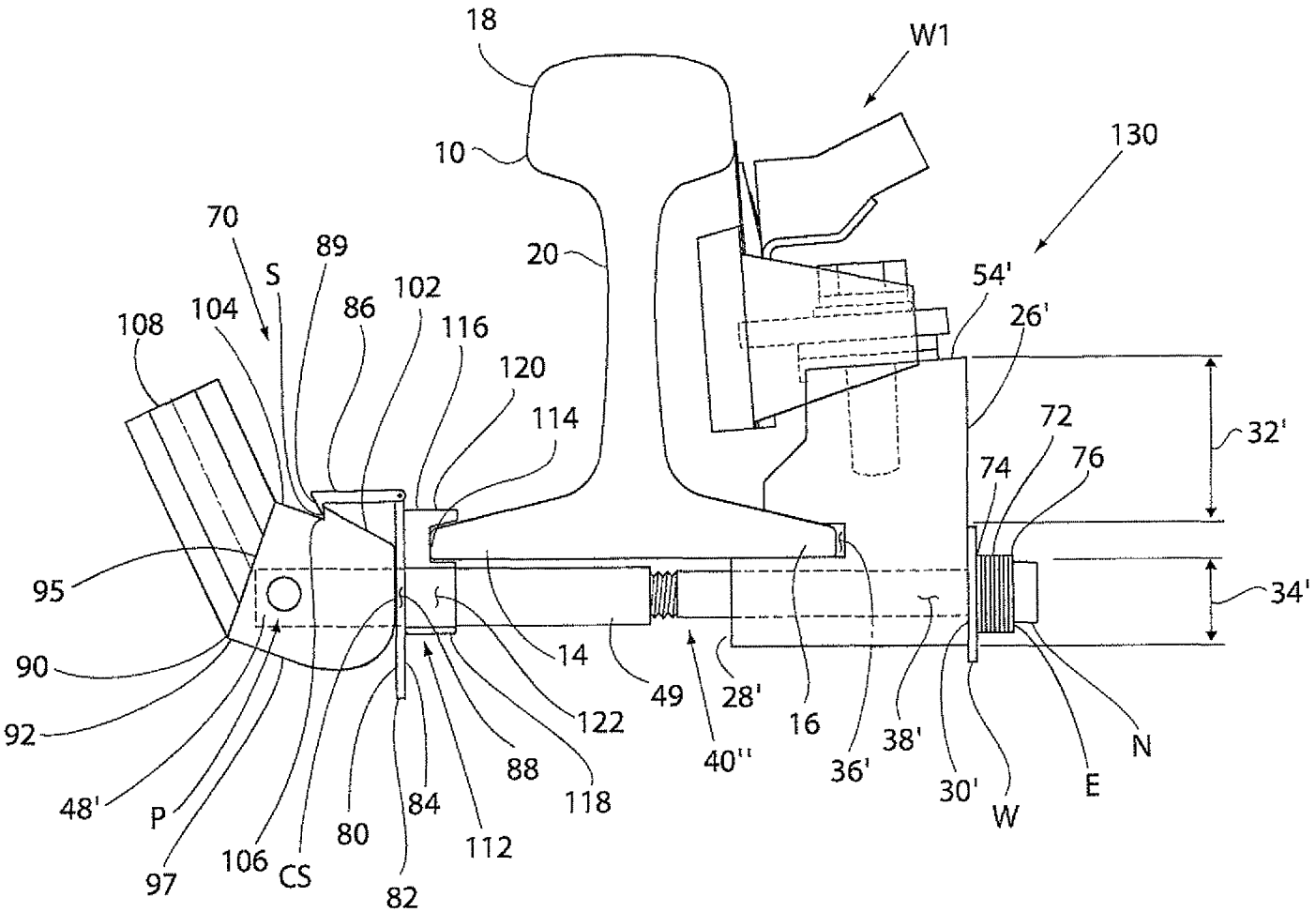
FIG. 7 is an elevational side view of the clamp shown in FIG. 6, wherein the clamp is shown mounted to a railroad rail in a clamped position.

FIGS. 6 and 7 show a third embodiment of a mounting clamp 130 that is similar to mounting clamp 110, except for the differences noted below. Like reference numerals are used for like parts. Here, the cam member 90 and the bracket 80 are attached to the end portion 48' of shaft section 49 of the bolt 40" and the bracket 80 and cam member 90 are positioned adjacent the base receiving member 112. The straight section 46' of the bolt 40" includes a head portion N, such as a nut fastened to the end portion 48' of the shaft 49 of the bolt 40", that is configured to engage the second end 30' of the clamp body 26'. The head portion N may also be a fixed portion of the straight section 46' of the bolt 40" that extends radially outward from the bolt 40". The second end 76 of the spring 70 abuts against the head portion N to prevent the spring 72 from coming off. The bore 122 of the base receiving member 112 receives the shaft section 49 of the bolt 40" thereby allowing the shaft section 49 to move within the bore 122. Although the cam 90 and the bracket 80 are on the opposite end of the bolt 40" from clamp 110, the clamp 130 operates in the same manner as clamp 110. FIG. 6 shows the spring 72 extended or loose when the clamp 130 is in a released position. FIG. 7 shows the spring 72 compressed when the clamp 130 is in a clamped position.

Figure 8:
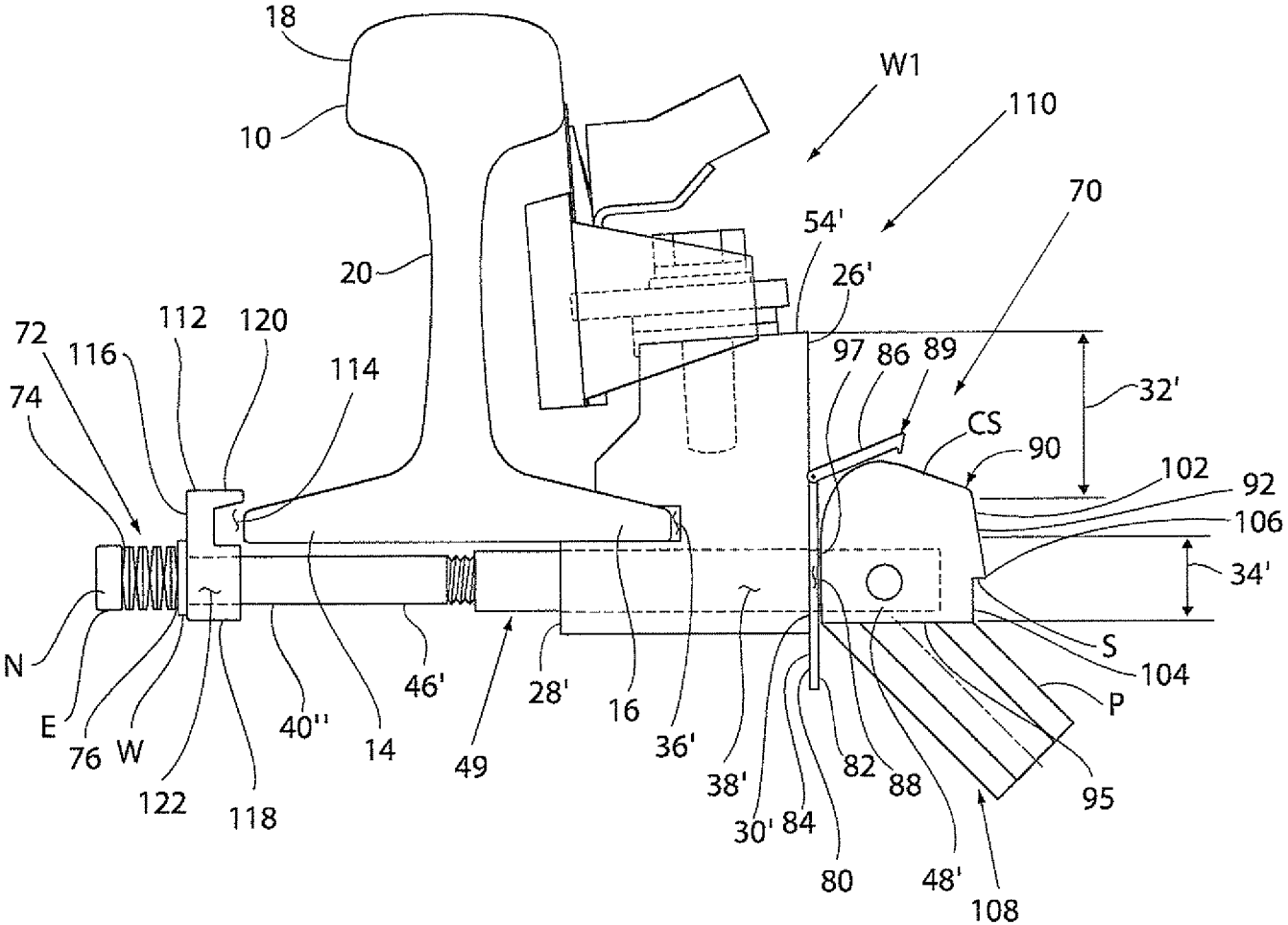
FIG. 8 is an elevational side view of a clamp device according to yet another embodiment, wherein the clamp device is shown mounted to a railroad rail in a released position.
Figure 9:
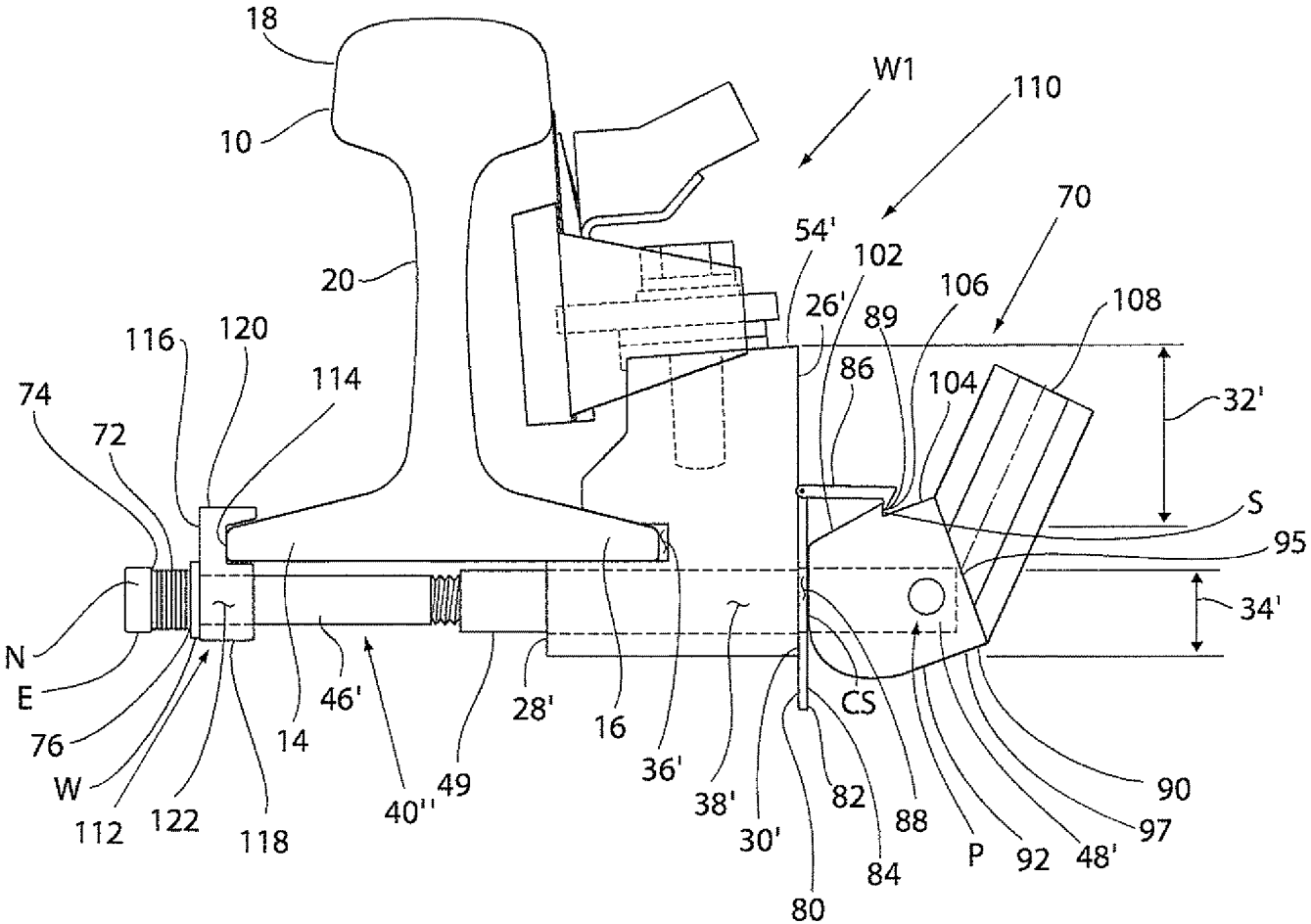
FIG. 9 is an elevational side view of the clamp device shown in FIG. 8, wherein the clamp device is shown mounted to a railroad rail in a clamped position.

FIGS. 8 and 9 show an alternative embodiment of the mounting clamp 110 shown in FIGS. 4 and 5 discussed above. Instead of positioning the spring 72 and washer W between the cam member 90 and the clamp body 26' as shown in FIGS. 4 and 5, the washer is positioned adjacent the body 116 of the base receiving member 112 and the spring 72 is positioned between the washer W and the head portion N of the straight section 46' of the bolt 40". With the spring 72 positioned on the opposite side from the cam member 90 and the locking bracket 80, the cam member 90 and locking bracket 80 are positioned adjacent to the second end 30' of the clamp body 26'. During operation of the mounting clamp 110, the spring 72 is compressed between the head portion N and the base receiving member 112 and the locking bracket and the cam member 90 engage the second end 30' of the clamp body 26'. The clamp 110, however, operates in the same manner as clamp 60.

This invention has been described with reference to the preferred embodiments. Obvious modifications and alterations will occur to others upon reading and understanding the preceding detailed description. It is intended that the invention be construed as including all such modifications and alterations.

The invention claimed is:

1. A clamp device comprising:

a clamp body having an upper section and a lower section, a rail device secured to the clamp body, the clamp body defining a recess portion between the upper and lower sections and a bore extending through the lower section of the clamp body, the recess portion configured to receive a portion of a rail flange;

a bolt having a first end and a second end, the bolt extending through the bore of the clamp body, the first end of the bolt configured to receive a portion of a rail flange; and a quick release mechanism having a lever arm and a cam member, the cam member being pivotally connected to the second end of the bolt, the lever arm being connected to the cam member and having a clamped position and a released position whereby pivoting the lever arm from the released position to the clamped position causes the cam member to engage a second end of the clamp body and displace the bolt within the bore of the clamp body such that the first end of the bolt and the clamp body are drawn together.

2. The clamp device of claim 1, further comprising a spring positioned adjacent one of the first end and the second end of the bolt.

3. The clamp device of claim 2, further comprising a locking bracket positioned between the second end of the clamp body and the cam member, the locking bracket having a body with a first section and a second section, the first section being pivotally connected to the second section and defining an opening for receiving the bolt, the second section having a lip that engages a ledge defined by the cam member when the lever arm is in the clamped position.

4. The clamp device of claim 1, wherein the first end of the bolt includes a hook section defining a recess for receiving a portion of a rail flange.

5. The clamp device of claim 1, wherein the first end of the bolt includes a base receiving member having a body defining a recess for receiving a portion of a rail flange.

6. The clamp device of claim 1, wherein the bolt comprises:

a hook section corresponding to the first end of the bolt, the hook section defining a recess for receiving a portion of a rail flange;

a straight section having a threaded portion; and a shaft section corresponding to the second end of the bolt, the shaft section receiving the threaded portion of the straight section.

7. The clamp device of claim 1, wherein the bolt comprises:

a base receiving member corresponding to the first end of the bolt, the base receiving member having a body defining a recess for receiving a portion of a rail flange;

a straight section having a threaded portion; and a shaft section corresponding to the second end of the bolt, the shaft section receiving the threaded portion of the straight section.

8. The clamp device of claim 1, wherein the cam member comprises an abutting surface, a curved portion, and a straight portion, the abutting surface engaging the second end of the clamp body when the lever arm is in the released position, the curved portion engaging the second end of the clamp body when the lever arm transitions between the released positioned and the clamped position, and the straight section engaging the second end of the clamp body when the lever arm is in the clamped position.

9. The clamp device of claim 3, wherein the cam member comprises an abutting surface, a curved portion, and a straight portion, the abutting surface engaging the second end of the clamp body via the locking bracket when the lever arm is in the released position, the curved portion engaging the second end of the clamp body via the locking bracket and coacting with the spring when the lever arm transitions between the released position and the clamped position, and the straight section engaging the second end of the clamp body via the locking bracket and coacting with the spring when the lever arm is in the clamped position.

10. The clamp device of claim 1, wherein the bolt comprises one or more sections.

11. The clamp device of claim 1, wherein a length of the bolt is adjustable.

12. A clamp device comprising:

a clamp body having an upper section and a lower section, a wiping bar assembly secured to the clamp body, the clamp body defining a recess portion between the upper and lower sections and a bore extending through the lower section of the clamp body, the recess portion configured to receive a portion of a rail flange;

a bolt having a first end, a second end, and a head portion, the bolt extending through the bore of the clamp body, the head portion of the bolt being positioned adjacent the second end of the bolt and being configured to engage the clamp body;

a base receiving member positioned adjacent the first end of the bolt, the base receiving member having a body defining a recess portion configured to receive a portion of a rail flange; and a quick release mechanism having a lever arm and a cam member, the cam member being pivotally connected to the first end of the bolt, the lever arm being connected to the cam member and having a clamped position and a released position whereby pivoting the lever arm from the released position to the clamped position causes the cam member to engage the base receiving member and displace the bolt within the bore of the clamp body such that the base receiving member and the clamp body are drawn together.

13. The clamp device of claim 12, further comprising a spring positioned adjacent one of the first end and the second end of the bolt.

14. The clamp device of claim 13 further comprising a locking bracket positioned between the base receiving member and the cam member, the locking bracket having a body with a first section and a second section, the first section being pivotally connected to the second section and defining an opening for receiving the bolt, the second section having a lip that engages a ledge defined by the cam member when the lever arm is in the clamped position.

15. The clamp device of claim 14, wherein the cam member comprises an abutting surface, a curved portion, and a straight portion, the abutting surface engaging the base receiving member via the locking bracket when the lever arm is in the released position, the curved portion engaging the base receiving member via the locking bracket and coacting with the spring when the lever arm transitions between the released positioned and the clamped position, and the straight section engaging the base receiving member via the locking bracket and coacting with the spring when the lever arm is in the clamped position.

16. The clamp device of claim 13, wherein the bolt comprises:

a straight section having a threaded portion; and a shaft section corresponding to the first end of the bolt, the shaft section receiving the threaded portion of the straight section.

17. The clamp device of claim 12, wherein the cam member comprises an abutting surface, a curved portion, and a straight portion, the abutting surface engaging the base receiving member when the lever arm is in the released position, the curved portion engaging the base receiving member when the lever arm transitions between the released position and the clamped position, and the straight section engaging the base receiving member when the lever arm is in the clamped position.

18. The clamp device of claim 12, wherein the bolt comprises one or more sections.

19. The clamp device of claim 12, wherein a length of the bolt is adjustable.

20. A method of securing a clamp device for mounting a rail device onto a railroad rail, the method comprising the steps of:

positioning the clamp device of claim 1 adjacent to a first flange of a railroad rail;

positioning the first end of the bolt adjacent to a second flange of the railroad rail, the bolt extending through the bore of the clamp body;

pivoting the quick release mechanism from the released position to the clamped position such that the first end of the bolt and the clamp body are drawn together and the recess portion of the clamp and the first end of the bolt engage respective portions of the first and second flanges, the quick release mechanism having a lever arm and a cam member; and securing the quick release mechanism in the clamped position by engaging the quick release mechanism with a locking bracket when the quick release mechanism is in the clamped position.

21. The method of claim 20, wherein the first end of the bolt includes a hook section defining a recess for receiving a portion of the second flange.

22. The method of claim 20, wherein the first end of the bolt includes a base receiving member having a body defining a recess for receiving a portion of a rail flange.

23. The method of claim 20, further comprising the step of:

adjusting a length of the bolt by displacing a threaded portion of the bolt within a shaft section of the bolt, the shaft section having a corresponding threaded portion to receive the threaded portion of the bolt.

* * * * *